US006293692B1

(12) United States Patent
Bowsher et al.

(10) Patent No.: US 6,293,692 B1
(45) Date of Patent: Sep. 25, 2001

(54) MULTIPURPOSE CONTAINER STRUCTURE

(76) Inventors: M. William Bowsher; Thomas S. Schwartz, both of P.O. Box 194, Lincoln, MA (US) 01773

( * ) Notice: Subject to any disclaimer, the term of this patent is extended or adjusted under 35 U.S.C. 154(b) by 0 days.

(21) Appl. No.: 09/435,243

(22) Filed: Nov. 5, 1999

(51) Int. Cl.[7] ..... B01F 15/00; B65D 43/04

(52) U.S. Cl. ..... 366/130; 366/343; 220/698; 220/798; 220/799

(58) Field of Search ..... 220/608, 695, 220/696, 698, 700, 701, 702, 734, 731, 770, 773, 774, 656, 657, 658, 659, 660, 669, 675, 570, 571.1, 571, 572, 798, 799; 366/129, 130, 343

(56) References Cited

U.S. PATENT DOCUMENTS

| | | | | |
|---|---|---|---|---|
| 181,516 | * | 8/1876 | Fitzhugh . | |
| 332,043 | * | 12/1885 | Brien . | |
| 699,861 | * | 5/1902 | Wiedenbauer . | |
| 733,984 | * | 7/1903 | Lucas | 222/570 |
| 912,095 | * | 2/1909 | Eason . | |
| 1,196,492 | * | 8/1916 | Sykes . | |
| 1,219,402 | * | 3/1917 | Rutan . | |
| 1,304,415 | * | 5/1919 | Tucker . | |
| 1,466,084 | * | 8/1923 | Burrows . | |
| 1,616,288 | * | 2/1927 | Taliaferro . | |
| 1,696,240 | * | 12/1928 | Kircher, Jr. | 220/698 |
| 1,743,283 | * | 1/1930 | Porges . | |
| 2,022,342 | * | 11/1935 | Drood . | |
| 2,084,084 | * | 6/1937 | Greer | 222/698 |
| 2,305,374 | * | 12/1942 | Beasley et al. . | |
| 2,427,004 | * | 9/1947 | Kampf . | |
| 2,634,020 | * | 4/1953 | Bartholomew . | |
| 2,663,455 | * | 12/1953 | Sebell . | |
| 2,671,239 | * | 3/1954 | Wisner . | |
| 2,885,108 | * | 5/1959 | Donoghue | 220/698 |
| 3,172,386 | * | 3/1965 | West . | |
| 3,223,272 | * | 12/1965 | Vernon . | |
| 3,326,409 | * | 6/1967 | Speer . | |
| 3,829,926 | * | 8/1974 | Salladay . | |
| 3,945,527 | * | 3/1976 | Pylant . | |
| 3,994,424 | * | 11/1976 | Koeller . | |
| 4,203,537 | * | 5/1980 | McAlister . | |
| 4,350,445 | * | 9/1982 | Osson | 366/129 |
| 4,418,829 | * | 12/1983 | Clay . | |
| 4,491,234 | * | 1/1985 | Wilcock . | |
| 4,756,439 | * | 7/1988 | Perock . | |
| 5,160,067 | * | 11/1992 | Luber . | |
| 5,199,571 | * | 4/1993 | Wolff et al. | 220/773 |
| 5,224,617 | * | 7/1993 | Gaudreault . | |
| 5,314,060 | * | 5/1994 | Bedrossian . | |
| 5,358,148 | * | 10/1994 | Hanifl et al. . | |
| 5,404,611 | * | 4/1995 | Raney . | |
| 5,566,861 | * | 10/1996 | Serano . | |
| 5,779,093 | * | 7/1998 | Poole et al. . | |
| 5,813,565 | * | 9/1998 | Huot . | |

* cited by examiner

*Primary Examiner*—Tony G. Soohoo
(74) *Attorney, Agent, or Firm*—O'Connell Law Firm

(57) ABSTRACT

A multipurpose container structure with a container body that has sealingly engaged walls, a bottom sealingly engaged with the walls, and a rim that surrounds the open top of the container body. The container body may be generally rectangular with at least one rounded corner and may include a U-shaped bail with an arcuate bend in a handle portion thereof. The rim may have an inner first trough and an outer second trough with each having a plurality of apertures therein. A pour spout may be disposed in one corner of the container body, and the first trough and the plurality of apertures can terminate adjacent to the pour spout. A lid may be provided that has inner and outer crests for engaging the first and second troughs of the rim. A plurality of male projections can extend from the inner and outer crests for engaging and clearing the plurality of apertures of the first and second troughs. An insert in the form of an elongate body with a plurality of male projections disposed thereon may be included for engaging at least the first trough and the plurality of apertures therein. Still further, a stirring paddle with an elongate handle that retains a curved paddle may be included for stirring the contents of the container body.

34 Claims, 4 Drawing Sheets

MULTIPURPOSE CONTAINER STRUCTURE

FIELD OF THE INVENTION

The present invention relates generally to container structures. Stated more particularly, disclosed and protected by this patent is a container structure for retaining a wide variety of materials including liquids, such as paints, and other materials including viscous compounds and powders that is of a configuration that provides for improved access, surface application, storing, and maintenance of a variety of materials in a cleaner and more efficient manner and that provides for improved pouring and stirring when employed relative to liquids, such as paints, stains, and varnishes.

BACKGROUND OF THE INVENTION

Containers of a wide variety of types have existed for thousands of years. For example, it is necessarily true that containers for paint have existed since the very invention of paint itself. As one would expect, a number of inventors have sought to provide improved containers in the hope of remedying one or more realized deficiencies exhibited by then state of the art devices. Some such devices have been of general utility for retaining substantially any material. Other containers have been specifically adapted for retaining particular materials, such as liquids, compounds, or solids. The advances represented by each of these containers are of undisputed utility, and one must appreciate that each of these has contributed to today's overall state of the art.

Nonetheless, one fully knowledgeable in particular fields of endeavor, such as painting, will be aware that there remain a number of deficiencies in the state of the art of containers. Certain of these deficiencies can be described as resulting from a failure on the part of the particular prior art device to address the problem sought to be addressed completely or adequately. Other deficiencies are manifest by the prior art invention's addressing one issue while ignoring or actually worsening other aspects of the resulting container design.

By way of example, one experienced in the field of painting will be aware that the initial steps in applying paint to a given surface with a brush comprise dipping the bristles of the brush into the paint container to coat and saturate the bristles with a volume of paint and then wiping markedly excess paint from the bristles by scraping the flat brush against the annular inner edge of the top of the paint can. However, as this is done, paint is often completely removed from the outer edges of the flat brush while excess paint remains at the middle of the brush. A number of problems are thus created. For example, applying paint evenly to a given surface is hindered whereby multiple brush strokes are required simply to develop an even paint distribution. Furthermore, with excessive paint clinging to the middle of the paintbrush, even an experienced painter must be wary of paint dripping from the brush onto surrounding surfaces. Still further, controlling the amount of paint on the brush is difficult since the painter must attempt to strike a balance between scraping too much paint from the brush whereby dipping is required too frequently and not scraping enough paint whereby dripping paint is likely.

Advantageously, a number of inventors have attempted to accommodate this deficiency. For example, in U.S. Pat. No. 3,945,527, Pylant discloses a paint brush wiping device that essentially comprises an circular lid with a rectangular brush opening that includes a straight wiper blade for providing a flat surface against which one can scrape a paint brush. With this, the Pylant device accomplishes a number of its stated goals relative to scraping paint from a paintbrush simply, neatly, and evenly. In doing so, however, Pylant forces its users to sacrifice a number of things including full access to the retained paint whereby pouring from and into the paint can is impeded as is ready stirring of the paint within the can. Also, a number of further devices with similar goals have been disclosed that must be purchased separately from the main container and then individually installed, maintained, and transferred, which results in added inconvenience and expense. With this, one will appreciate that a container that would provide an optimal scraping surface while not sacrificing, and indeed improving, other characteristics of the container would be useful.

Another shortcoming that has afflicted prior art containers, particularly paint containers, derives from the construction of the can that is required for creating a sealing, mating relationship between the paint can and the paint can lid. A typical prior art paint can has an upper annular rim that is defined by an outer annular ridge and an inner annular ridge with a torroidal trough running coextensively therebetween. A typical paint can lid comprises a round disk with a rounded torroidal ridge that frictionally engages the torroidal trough in the upper annular rim of the paint can in a liquid-tight relationship. This sealing engagement is optimized when a light coat of paint is disposed between the engaging elements. Unfortunately, the paint can's torroidal trough inevitably traps paint, both during pouring and with repeated scrapings of the brush against the paint can's inner annular edge. With this, paint will tend to drip down the side of the paint can over time and especially when a painter seeks to reinstall the paint can lid.

Industrious inventors have sought to remedy this problem by, for example, providing a plurality of apertures in the torroidal trough in the upper edge of the paint can with the intended purpose of continuously draining paint from the trough back into the body of the paint can. Disadvantageously, such single trough designs can nonetheless allow paint to spill down the side of a paint can because the single groove can fill with paint temporarily before having sufficient time to drain and because the typically narrow relationship of the inner and outer ridges of the paint can's upper rim can allow the paint brush to demonstrate a whipping effect during scraping whereby paint can spray onto adjacent surfaces.

Furthermore, one will appreciate that, by its very nature, paint dries over time, which is quite desirable when it is on a wall or the like. However, when the paint resides in the paint can's trough, the paint's drying renders the apertures in the trough useless whereby a user must forego the advantages otherwise offered by the apertures or be troubled with clearing the dried paint from the trough and the clogged apertures. In this light, one will appreciate that a container for materials such as paint that enables a proper sealing engagement between a lid and the container while simultaneously providing a means for preventing a trough of the container from accumulating liquid and still further preventing a drying of the liquid from interfering with the means for preventing liquid from accumulating in the trough.

Similar issues relative to dribbling and dripping are manifest when one attempts to pour liquid, such as paint, from the round can over the inner and outer ridges and the trough that separates them. As paint flows over a large circumferential portion of the rim of the paint can, it tends to form a wide stream that is difficult to direct. Furthermore, paint tends to dribble down the side of the round paint can, which leads to waste and mess. Also, paint can accumulate in the trough in the paint can rim if apertures are not provided or if those apertures have become clogged, which can lead to further mess and waste and can make resealing the paint can difficult. Although a number of inventors have attempted to address these deficiencies, one knowledgeable in the art will be aware that there remains a need for a container that provides an improved pour spout while allowing a simple and effective sealing of the container.

A still further problem experienced by users of containers that have bails for use as handles is that the user's fingers and hand often are pinched between the bail and the container as the container is lifted. As any user who has personally experienced such a pinching would attest, a container remedying this deficiency would be worthwhile.

Yet another issue presented by prior art containers relates to stirring or mixing the material retained within the container. Round containers certainly allow ready movement of the material within the container, but the smoothness of the containers wall does not tend to sponsor the very turbulence that the user is seeking to create. Furthermore, during storage and transportation, round containers result in significant wasted space. Although square containers have been disclosed in the prior art, these containers create a further problem by insulating the volume of material adjacent to the corner from the stirring turbulence and making access to material adjacent to the corner difficult during cleaning, stirring, and, attempted removal. Consequently, it will be appreciated that a container that provides for enhanced stirring or mixing and improved storage and shipping while not hindering cleaning and the like would be desirable.

In light of the foregoing, it becomes clear that containers, even those designed for particular purposes and to accommodate particular issues, continue to suffer from a plurality of deficiencies. Accordingly, one will recognize that a container providing a solution to one or more of the aforementioned deficiencies experienced by the prior art would be useful. However, it is clearer still that a container presenting a solution to each and every of the above-described problems left by the prior art while providing a number of heretofore-unrealized advantages thereover would represent a marked advance in the art.

SUMMARY OF THE INVENTION

Advantageously, the present invention is founded on the broadly stated object of providing a multipurpose container structure that meets each of the aforedescribed needs left by the prior art while providing a number of heretofore-unrealized advantages, thereover. It is a further object of the invention to provide a container structure that accomplishes this broadly stated object while not compromising the functionality of the container structure in any single respect.

A further object of the invention is to provide a multipurpose container structure that is of greater overall user friendliness whereby the container structure enhances the true utility of the contained material by reducing the physical effort required for removal of the material from the container, by easing application of the material to a given surface, and by reducing the time required for cleaning and storing the container structure after use.

Another object of the invention is to provide a container structure that resultantly reduces the overall time required for completing a project cycle while simultaneously reducing project costs and improving overall project quality.

Accordingly, a particular object of the present invention is to provide a container structure that allows for an even, clean, and consistent removal of paint or other liquid from a dipped brush, trowel, or the like while not detracting from the accessibility or other characteristics of the container structure.

A further object of the invention is to provide a container structure that resists the accumulation of liquid in its rim structure.

A resultant object of the invention is to provide a container structure that exhibits a substantially fail-safe configuration for preventing spills, dripping, and dribbling of a retained material, such as liquid, from the rim of the container structure by returning errant liquid to the open inner volume of the container structure.

A further object of the invention is to provide such a container structure that simultaneously provides for an effective sealing engagement between a container body and a container lid.

Yet another object of the invention is to provide a container structure that returns errant liquid to the open inner volume of the container structure without malfunction by actively resisting clogging.

Still another object of the invention is to provide a container structure that allows for neat and controllable pouring from the container structure while allowing a simple and effective sealing of the container structure.

A still further object of the invention is to provide a container structure that effectively prevents a user's fingers and hand from being pinched between the bail and container body of the container structure.

An even further object of the invention is to provide a container structure that provides for enhanced stirring turbulence in a retained material while not hindering cleaning of the container structure.

An additional object of the invention is to provide a container structure that is more efficient and stable in storage, shipping, and use.

Naturally, these and further objects and advantages of the invention will be obvious both to one who reviews the present disclosure and to one who has an opportunity to make use of an embodiment of the invention disclosed herein.

In accomplishing these objects, the present invention for a container structure is founded on a container body. A top of the container body is generally open and is bounded by a rim. A bail in the shape of a half rectangle is provided for enabling a user to lift, carry, and hang the container structure without a danger of pinching the user's fingers or hand between the bail and the container body.

The preferred container body is generally square or rectangular whereby it has four walls and a sealingly engaged bottom that together define an open inner volume. The walls meet in rounded corners that are arcuately radiused. With this, the container structure could retain substantially any material. Furthermore, the open inner volume of the container structure could be varied widely within the scope of the invention depending, for example, on the needs of the user and the nature of the retained material. For example, the container structure could be formed with a small inner volume of just a half-pint, a large inner volume of five gallons, or an inner volume deriving from a container structure designed to occupy the space that a round container structure would otherwise occupy.

The rim of the container structure provides a straight first contact edge that projects inwardly toward the middle of the container body at a downward angle. With this, a user can readily scrape paint or the like from a brush evenly and neatly with little danger of spillage. A first trough falls downwardly between an upstanding first ridge that is adjacent to the first contact edge and an upstanding second ridge that is disposed more proximally to the periphery of the rim. Furthermore, a second trough is disposed between the upstanding second ridge and an upstanding third ridge. Under this arrangement, any paint or other liquid reaching beyond the first contact edge will tend to fall into the first trough, and any paint flooding beyond the first trough will fall into the second trough, which thus acts as a fail-safe for preventing spilling and dribbling.

The preferred container structure is improved still further by the inclusion of a plurality of apertures disposed along substantially the entire lengths of both the first and second troughs. Advantageously, any paint or other flowable material that flows into the first or second troughs will tend to return to the open inner volume of the container structure thereby further preventing spilling and the like.

The functionality of the preferred container structure is enhanced yet further by the provision of a smooth pour spout with a semicircular mouth in one of the rounded corners of the container structure. With the provision of the pour spout, the invention enables a smooth and controllable stream of liquid during pouring. Ideally, the pour spout is provided without unduly compromising the benefits of the dual-trough rim by having the upstanding first ridge and the first trough smoothly dwindle toward the corner in which the pour spout is disposed until the first trough is nonexistent over substantially the entire span of the corner. With this, the pour spout assumes the same smooth radius of the corner, but the second trough and the second and third ridges remain for preventing spillage and allowing a sealing engagement between the container body and a lid, which will be described below. In a preferred embodiment of the invention, the series of apertures cease adjacent to the corner where the pour spout is provided whereby liquid is prevented from surging upward through the non-provided apertures during pouring.

Optimal embodiments of the invention further include a lid that is founded on a flat panel of similar size and shape as the rim. An outer crest, which mirrors the second trough in size, shape, and cross section, projects from the flat panel about the entire periphery thereof, even in the location of the pour spout, whereby the two can matingly engage in a frictional relationship to create an uninterrupted fluidic seal therebetween. Even further though, the outer crest can be supplemented by an inner crest that matingly engages the first trough to create a further fluidic seal between the lid and the rim.

In particularly preferred embodiments, each of the outer and inner crests can have a series of male projections that project therefrom that are arranged and sized to engage the apertures in the troughs of the rim in a mating relationship. When included, the male projections not only further enhance the fluidic seal between the lid and the rim, but they also clear any residual paint or other material from the apertures with each engagement of the lid and the rim whereby the apertures will be constantly operational without a need for manual intervention.

Of course, one should remain mindful that the foregoing discussion is designed merely to outline broadly the more important features of the invention to enable a better understanding of the detailed description that follows and to instill a better appreciation of the inventors' contribution to the art. Before an embodiment of the invention is explained in detail, it must be made clear that the following details of construction, descriptions of geometry, and illustrations of inventive concepts are mere examples of possible manifestations of the invention.

DETAILED DESCRIPTION OF PREFERRED EMBODIMENTS

As with many inventions, the present invention for a container structure can assume a wide variety of embodiments. However, to assist those reviewing the present disclosure in understanding and, in appropriate circumstances, practicing the present invention, a preferred embodiment of the instant invention for a container structure will be disclosed hereinafter.

Figure 1:
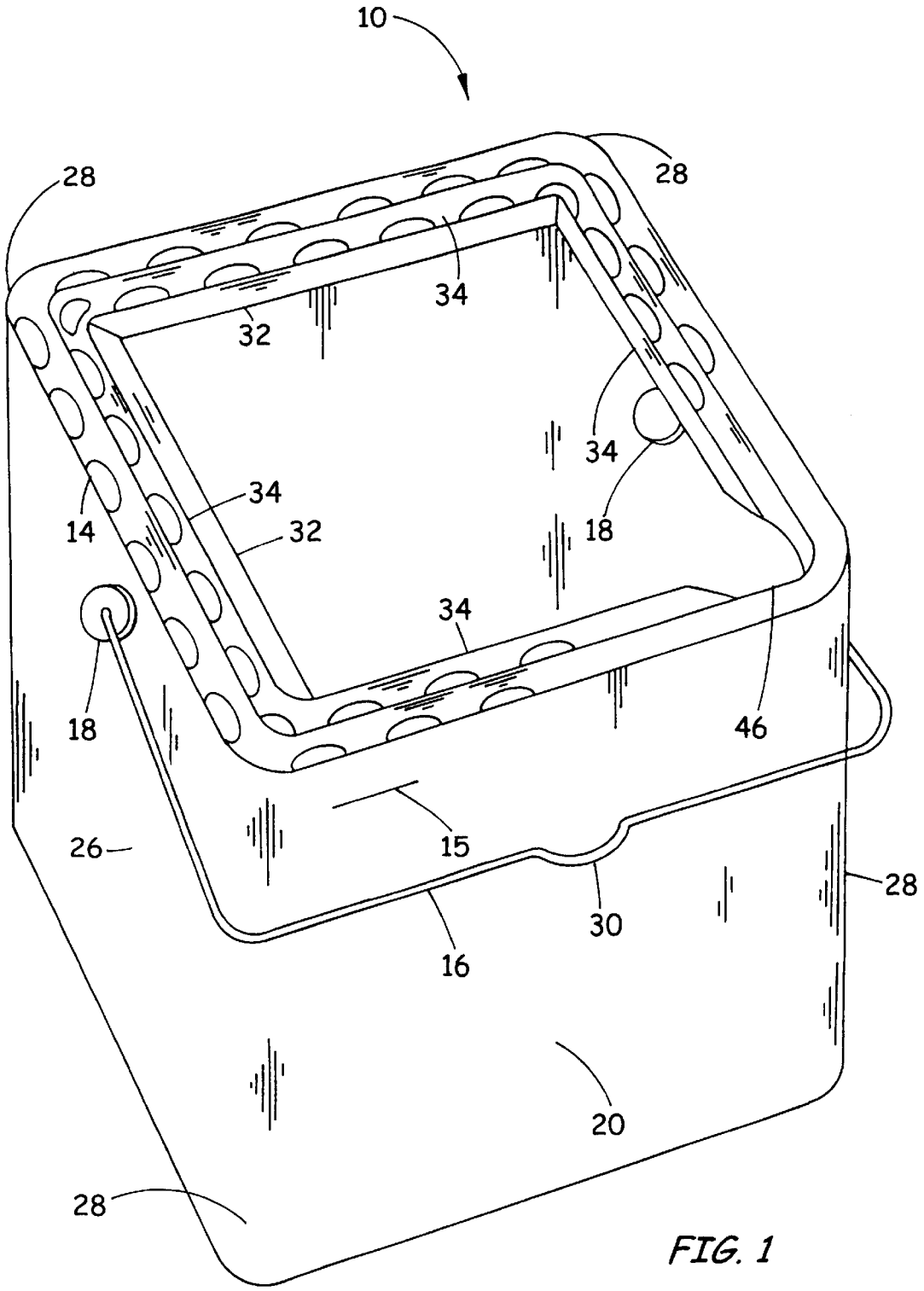
FIG. 1 is a perspective view of a multipurpose container structure according to the present invention.

Looking more particularly to the drawings, a preferred embodiment of the present invention for a container structure is indicated generally at 10 in FIG. 1. The container structure 10 is founded on a container body 12. The top of the container structure 10 is generally open and is bounded by a rim 14 that defines an upper periphery of the container structure 10. A bail 16 is rotatably coupled at its ends to the container body 12 by hollow disks 18, which will be described in greater detail below.

Figure 2:
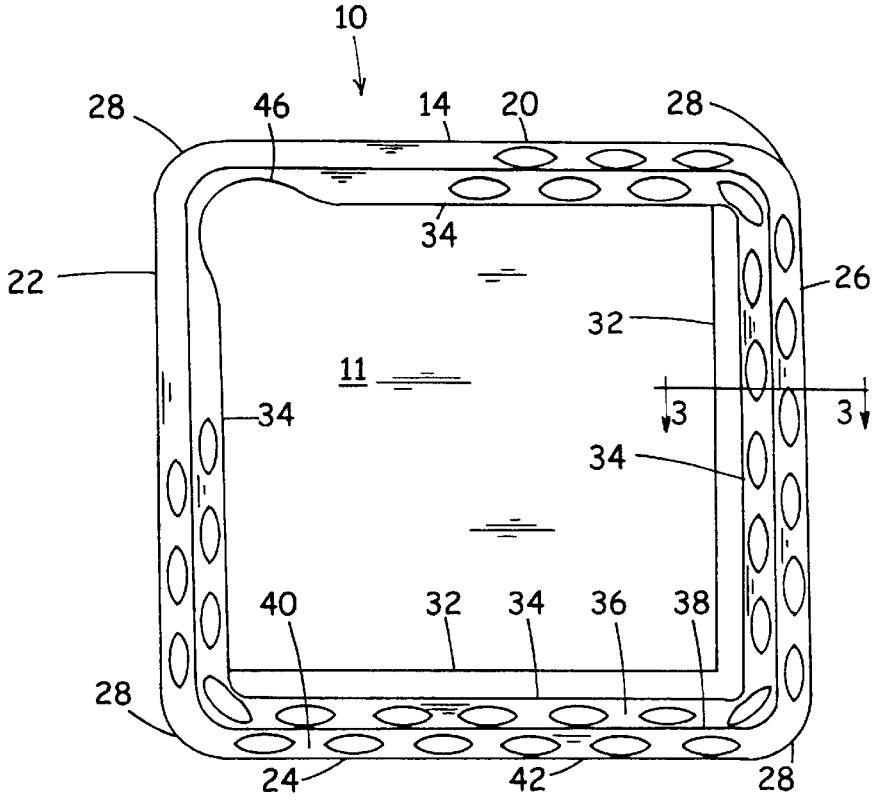
FIG. 2 is a top plan view of the container structure of FIG. 1.

By combined reference to FIGS. 1 and 2, one sees that the container body 12 is of a rectangular, preferably square, configuration. With this, the illustrated embodiment of the container body 12 has a first wall 20, a second wall 22, a third wall 24, and a fourth wall 26. It is notable, however, that the four walls 20, 22, 24, and 26 of the container body 12 do not intersect perpendicularly. Instead, the walls 20, 22, 24, and 26 meet in rounded corners 28 that are arcuately radiused.

The four walls 20, 22, 24, and 26 in combination with a container bottom 11 that is sealingly engaged with the walls 20, 22, 24, and 26 define an open inner volume for containing a volume of material (not shown). One will appreciate that the contained material could be substantially any material including liquids such as paint, thicker compounds such as Spackle or putty, powders, granular material, or any other material that would be usefully retained in such a container structure 10.

Furthermore, it should be noted that the container structure 10 could be crafted with an open inner volume of substantially any capacity. With this, the container structure 10 could be crafted not only in the presently popular one, two, two and one-half, or five gallon capacities but also in a wide variety of other capacities including quarts, pints, and half-pints. Still further, the container structure 10 could be formed with the goal of occupying the same space that a round can otherwise would occupy by being square and having a width equal to the diameter of a typical round can. With this, the container structure 10 would be susceptible to the same boxing, shipping, and storing methods as prior art round cans but would be capable of retaining a greater volume of paint in that same boxing, shipping, and storage volume. Under this arrangement, the container structure 10 would retain some volume of material beyond a gallon. For example, the container structure 10 could define a new standard, such as one and one-half gallons.

The flat walls 20, 22, 24, and 26 and the rounded corners 28 of the container body 12 combine to achieve a plurality of advantages. For example, when the container structure 10 is employed for retaining a liquid such as paint (not shown), the generally rectangular nature of the container body 12 enhances the ability of a user to stir the retained paint by creating greater turbulence than would be experienced with a round container (not shown) that simply allows the paint to assume the laminar swirl of a whirlpool. With this, the container body 12 provides for enhanced mixing of ingredients that may have settled during storage and shipping. However, by providing radiused corners 28, the container body 12 nonetheless permits ready cleaning of the inner volume of the container body 12 including the corners 28.

Furthermore, by providing flat walls 20, 22, 24, and 26 that assume a generally square configuration, the container structure 10 is susceptible to more efficient storage and transportation than prior art round containers that necessarily leave large volumes of empty space between adjacent containers. As FIG. 1 indicates, this ability is further enhanced by the invention's construction of the disks 18 that retain the ends of the bail 16. In marked opposition to the disks of prior art containers that reside external to the container body to occupy a space of one-half inch or more, the disks 18 of the present invention are contained internally within the container body 12 whereby the outer surfaces of the disks 18 are flush with the second and fourth walls 22 and 26. With this, the container body 12 can exhibit a narrower width than it would with external disks, and still further space can be saved for more efficient storage, shipping, and packaging.

Also, the generally square container body 12 resists undesirable movement both during storage and use. For example, when a container structure 10 is hung from a ladder (not shown) as by a hook or the like (not shown), a full side 20, 22, 24, or 26 will be in contact with a rung of the ladder. With this, the container structure 10 actively resists rolling and twisting, which the experienced artisan will appreciate occurs all too often with prior art round containers that can twist, roll, and even fall thereby leading to a spilling of possibly the entire contents of the container.

The container structure 10 is improved still further by the disposition of a fill line 15 on the first wall 20. Although the fill line 15 could be disposed at a wide variety of heights, it seems presently preferred to dispose the fill line 15 approximately three-quarters of an inch below the rim 14. With this, a user will be advised of an optimal filling capacity. When the container structure 10 is filled no higher than the height of the fill line 15, neat pouring will be facilitated, and the messy pouring that often attends a can that is filled to immediately adjacent to its rim will be avoided.

The bail 16 of the present invention accommodates the generally rectangular container body 12 by assuming the corresponding shape of a half rectangle that is of slightly larger dimensions than the exterior of the container body 12. As a result, the bail 16 can be rotated readily about the disks 18 from the disposition illustrated in FIG. 1 to an upright position (not shown) for carrying, hanging, and the like. Under this arrangement, one will appreciate that it is difficult or impossible for a user to wedge his or her fingers between the bail 16 and the container body 12 whereby the disadvantageous phenomenon of pinching therebetween is substantially eliminated. A further nuance of the bail 16 is the provision of a semicircle 30 that is centered along a handle portion of bail 16. Advantageously, the semicircle 30 allows for a most stable and consistent hanging of the container structure 10 as from a ladder hook or the like.

Figure 3:
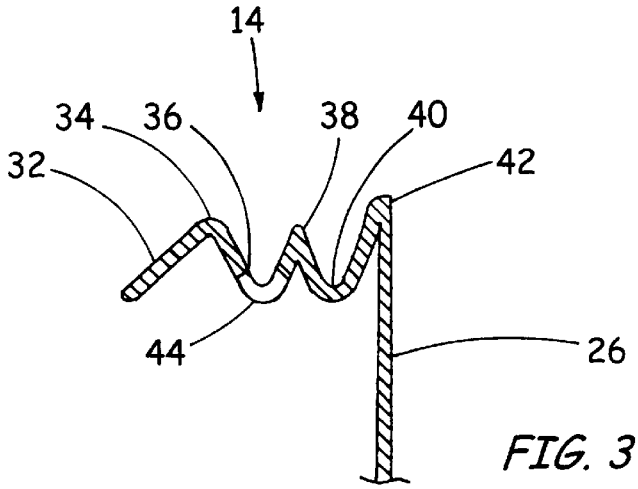
FIG. 3 is a view in cross section of the rim portion of the container structure taken along the line 3—3 in FIG. 2.

Although the above-described container structure 10 certainly provides a number of improvements over prior art containers, a plurality of additional advantages are achieved in this preferred embodiment of the invention by the unique configuration of the rim 14. That configuration of the rim 14 can be best understood by combined reference to the perspective view of FIG. 1, the top plan view of FIG. 2, and the cross-sectional view of FIG. 3.

As FIG. 2 shows, the innermost portion of the rim 14 adjacent to the third and fourth walls 24 and 26 comprises what may be termed a first contact edge 32. The first contact edge 32 projects inwardly toward the middle of the container body 12 at a downward angle. Optimally, the first contact edge 32 is bowed slightly such that it presents a convex upper surface whereby it avoids damaging the bristles of a brush (not shown) that is drawn over the first contact edge 32. Relative to the third and fourth walls 24 and 26, the first contact edge 32 leads to an upstanding first ridge 34. Adjacent to the first and second walls 20 and 22, however, upstanding first ridge 34 comprised the innermost portion of the rim 14. A first trough 36 falls downwardly between the upstanding first ridge 34 and an upstanding second ridge 38. Similarly, a second trough 40 resides between the upstanding second ridge 38 and an upstanding third ridge 42 that essentially comprises the uppermost portion of the respective wall 20, 22, 24, or 26 of the container body 12. A plurality of apertures 44 are disposed along substantially the entire lengths of both the first and second troughs 36 and 40 as they traverse the third and fourth walls 24 and 26 and approximately one-half the length of the first and second walls 20 and 22 where they terminate as they approach the spout 46. In this embodiment, the apertures 44 are eye shaped. However, it will be clear that a plurality of different shapes would be readily obvious and are well within the scope of the present invention.

This arrangement leads to a multiplicity of advantages. With the straight, downwardly angled first contact edges 32 that correspond to the flat shape of most paint brushes (not shown), a user can remove excess paint from a paint brush in an even and consistent manner. Furthermore, with the downward angle of the first contact edges 32, removed paint will be more likely to fall back into the inner volume of the container body 12. Advantageously, paint finding its way beyond the upstanding first ridge 34 and, relative to the third and fourth walls 24 and 26, beyond the first contact edges 32 will tend to spill into the first trough 36 where it will tend to return to the inner volume of the container body 12 through the apertures 44 therein. With this, the first trough 36 and the apertures 44 therein act as an effective secondary means for preventing paint from spilling from the container structure 10. Most advantageously, though, where a volume of paint somehow floods beyond the upstanding first ridge 34, the first trough 36, and the upstanding second ridge 38, the second trough 40 with its apertures 44 acts as a fail-safe for preventing that paint from escaping the confines of the unique rim 14 structure.

Even further advantages are realized in this embodiment by the provision of a pour spout 46 in the corner 28 of the rim 14 where the first and second walls 20 and 22 meet.

Although it could possibly assume a variety of configurations, the pour spout 46 in this embodiment comprises a semicircular mouth for providing a smooth flow of liquid during pouring. Advantageously, the container structure 10 provides the pour spout 46 without unduly compromising the benefits of the dual-trough rim 14. To do so, the upstanding first ridge 34 and the first trough 36 smoothly dwindle toward the corner 28 until the first trough 36 is nonexistent over substantially the entire span of the corner 28 whereby the pour spout 46 assumes the same smooth radius of the corner 28. With this, a stream of liquid, such as paint, varnish, or stain, can be poured from the container structure 10 in a smooth and easily directed stream. Notably, the container structure 10 provides the pour spout 46 without sacrificing the above-described benefits of the second trough 40 and the second and third ridges 38 and 42.

One will also note that the series of apertures 44 in the first and second troughs 36 and 40 cease adjacent to the corner 28 where the pour spout 46 is located. Although it is within the scope of the present invention for the apertures 44 to continue over the entire first and second troughs 36 and 40, ceasing the apertures 44 adjacent to the pour spout 46 is useful for, by way of example, preventing the disadvantageous result of liquid surging upward through such non-provided apertures during pouring, which would result in a messy and uncontrollable plurality of streams of liquid.

Figure 4:
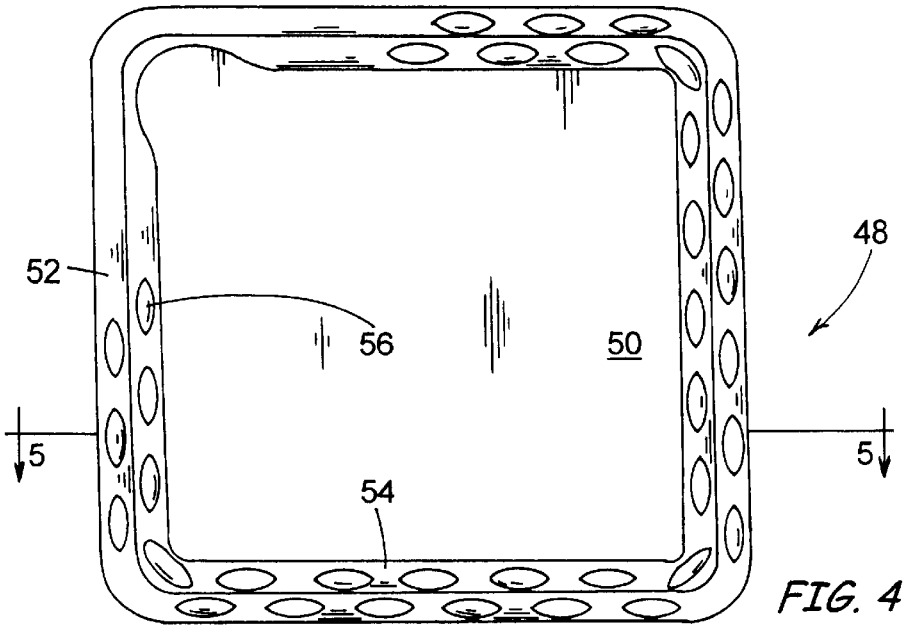
FIG. 4 is a bottom plan view of a lid according to the present invention.
Figure 5:
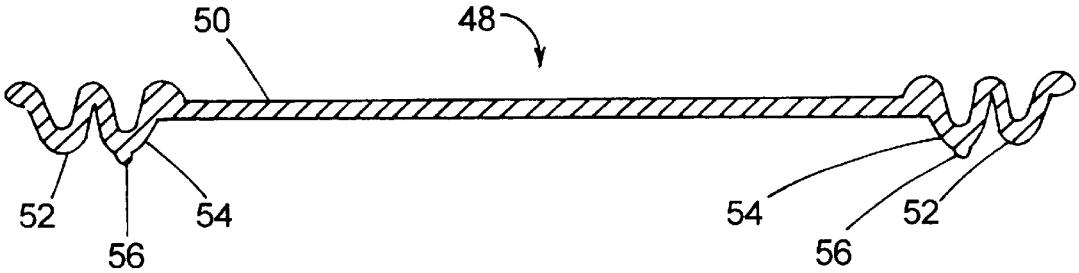
FIG. 5 is a view in cross section of the lid of FIG. 4 taken along the line 5—5.

As FIGS. 4 and 5 show, the unique configuration of the rim 14 begets a still more uniquely configured lid 48. The bottom plan view of FIG. 4 shows that the lid 48 is founded on a flat panel 50 that is sized and shaped to match the size and shape of the rim 14. Looking also to the cross sectional view of FIG. 6, one sees that an outer crest 52 that traverses the entire periphery of the flat panel 50 projects from adjacent to the outermost periphery of the flat panel 50. The outer crest 52 mirrors the second trough 40 in size, shape, and cross section whereby the outer crest 52 and the second trough 40 can matingly engage in a frictional relationship to create a fluidic seal therebetween. One will note that the second trough's 40 continuing around the entire periphery of the rim 14 becomes particularly advantageous when the lid 48 is mated with the rim 14 because it allows for the creation of a fluidic seal over the entire periphery of the container structure 10. Advantageously, though, the outer crest 52 is supplemented by an inner crest 54 that projects from the flat panel 50 just inside of the outer crest 52. Of course, the inner and outer crests 54 and 52 may be termed equally aptly first and second crests 54 and 52. As the outer crest 52 matched the second trough 40, the inner crest 54 matches the first trough 36 in size, shape, and cross section to create a further fluidic seal between the lid 48 and the rim 14.

In a most unique manner, the outer and inner crests 52 and 54 have dual series of male projections 56 that project therefrom. The male projections 56 are disposed on the outer and inner crests 52 and 54 to mate with the apertures 44 in the first and second troughs 36 and 40. Accordingly, the male projections 56 share the same layout and peripheral size as the apertures 44. With this, the male projections 56 not only further enhance the seal between the lid 48 and the rim 14, but they also clear any residual paint or other material from the apertures 44 with each engagement of the lid 48 and the rim 14. As a result, the invention ensures that the apertures 44 perform their intended function without requiring a user to clean the apertures 44 manually.

Figure 6:
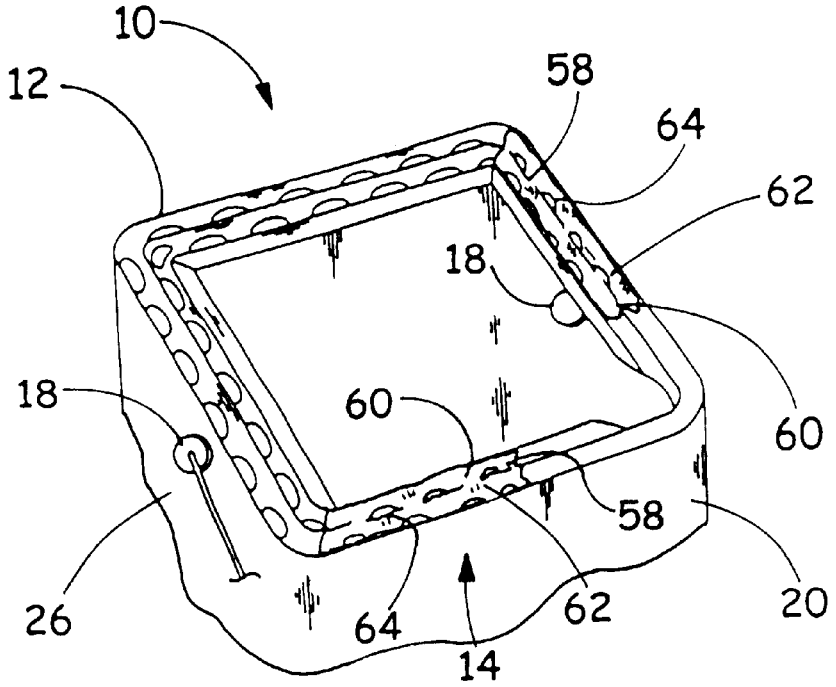
FIG. 6 is a perspective view of an alternative embodiment of the container structure of the present invention.

FIG. 6 illustrates still another improvement provided by the present invention in the form of a pair of inserts 58. In this embodiment, the inserts 58 comprise disposable paper elements that mirror the shape of the rim 14 of the container structure 10. Stated more particularly, the inserts 58 each have first and second elongate ridges 60 and 62 with a plurality of male projections 64 therealong. The male projections 64 are designed to correspond to the size, shape, and layout of the apertures 44 whereby they will plug the apertures 44 when the inserts 58 are in place. With this, the inserts 58 could be used with container structures 10 when they are completely full to prevent liquid from rushing upwardly through the apertures 44 during initial pouring. The inserts 58 could be interposed between the lid 48 and the container body 12 during initial filling, or the inserts 58 could be put in place by a user with a new or refilled container structure 10.

Figure 7:
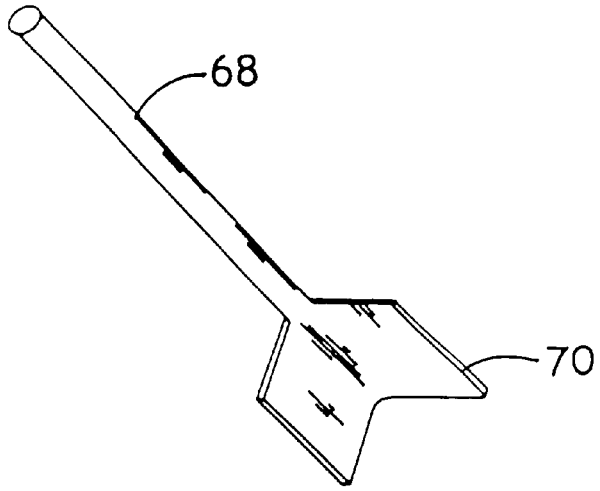
FIG. 7 is a perspective view of a stirring paddle according to the present invention.

Finally, FIG. 7 shows another aspect of the invention that comprises a stirring paddle 66 that is specially adapted to cooperate with the unique construction of the present invention's container body 12. In doing so, the stirring paddle 66 comprises an elongate handle 68 that retains a curved paddle 70. Ideally, the cross section of the curved paddle 70 will mirror the shape of the curved corners 28 of the container body 12. As a result, a user will be able to use the stirring paddle 66 to stir materials retained within the container structure 10 while being readily able to access the corners 28.

In light of the foregoing, it will be apparent that the present invention provides a number of advantages over prior art container structures. Undoubtedly, further advantages of the present invention beyond those specifically mentioned herein will be readily obvious both to one who has reviewed the present disclosure and to one who has an opportunity to make use of an embodiment of the present invention.

Furthermore, it will be clear that the present invention has been shown and described with reference to certain preferred embodiments that merely exemplify the broader invention revealed herein. Certainly, those skilled in the art can conceive of alternative embodiments. For instance, those with the major features of the invention in mind could craft embodiments that incorporate those major features while not incorporating all of the features included in the preferred embodiments set forth above.

In light of the foregoing, it shall be recognized that the following claims are intended to define the scope of protection to be afforded to the inventors, and the claims shall be deemed to include equivalent constructions insofar as they do not depart from the spirit and scope of the present invention. It should be recognized further that a plurality of the following claims express certain elements as a means for performing a specific function, at times without the recital of structure or material. As the law demands, these claims shall be construed to cover not only the corresponding structure and material expressly described in the specification but also equivalents thereof.

What is claimed is:

1. A multipurpose container structure comprising:

a container body with first, second, third, and fourth sealingly engaged walls, a bottom sealingly engaged with the first, second, third, and fourth walls, and an upper periphery that defines a rim and surrounds an open top of the container body whereby the first, second, third, and fourth walls and the bottom together define an open inner volume;

wherein the first, second, third, and fourth walls meet at four corners in a generally rectangular configuration;

wherein at least one of the corners is rounded; and wherein at least a portion of the rim comprises a first trough that falls between a first ridge and a second ridge for preventing material contained within the container structure from spilling out of the container structure;

whereby the generally rectangular configuration of the multipurpose container structure cooperates with the at least one rounded corner of the multipurpose container structure to allow for more efficient retention and storage of retained materials and whereby, when used to retain liquids, the generally rectangular configuration of the multipurpose container structure cooperates with the at least one rounded corner of the multipurpose container structure to induce turbulence during stirring of the retained liquid while allowing for access to material contained within the at least one rounded corner.

2. The multipurpose container structure of claim 1 further comprising a bail for carrying the container body wherein the bail has a first end rotatably coupled to the first wall of the container body, a second end rotatably coupled to the third wall of the container body, and a body portion wherein the body portion of the bail comprises a half rectangle shape with first and second legs coupled to the container body and a handle that couples the first and second legs whereby the bail mirrors the shape of the container body to prevent a user's fingers from being pinched between the container body and the bail.

3. The multipurpose container structure of claim 2 wherein the first and second ends of the bail are rotatably retained relative to the container body by retaining members that are disposed within the open inner volume of the container body whereby the retaining members and the container body present a compact configuration for efficient storage, shipping, and display.

4. The multipurpose container structure of claim 3 further comprising an arcuate bend in the handle of the bail to assist a user in retaining and hanging the container structure.

5. The container structure of claim 1 further comprising a fill line operably associated with the container body for indicating an optimal filling level of the container body.

6. The container structure of claim 1 wherein the portion of the rim comprising the first trough further comprises a second trough wherein the second trough is disposed distal to the first trough relative to the open inner volume of the container body whereby material contained within the container structure is further prevented from spilling out of the container structure.

7. The container structure of claim 6 further comprising a first contact surface that projects proximally from the first trough toward a central portion of the open inner volume of the container body.

8. The container structure of claim 7 wherein the first contact surface comprises a flat edge that presents a convex upper surface for removing surplus material from a tool that has been inserted into the container body for removing material from the container body.

9. The container structure of claim 6 further comprising a pour spout disposed in one of the four corners of the container body for allowing a smooth pouring of material from within the container body.

10. The container structure of claim 9 wherein the first and second troughs extend around substantially the entire rim of the container body except that the first trough terminates adjacent to the pour spout thereby leaving only the second trough in the portion of the rim adjacent to the pour spout.

11. The container structure of claim 6 further comprising a lid for engaging the rim of the container body to enclose the open inner volume of the container body wherein the lid has first and second crests for engaging the first and second troughs of the rim of the container body.

12. The container structure of claim 1 further comprising a plurality of apertures in the first trough for allowing material to drain from the first trough and into the open inner volume of the container body.

13. The container structure of claim 12 wherein the portion of the rim comprising the first trough further comprises a second trough wherein the second trough is disposed distal to the first trough relative to the open inner volume of the container body whereby material contained within the container structure is further prevented from spilling out of the container structure.

14. The container structure of claim 13 further comprising a plurality of apertures disposed in the second trough for further allowing material to drain into the open inner volume from the first and second troughs.

15. The container structure of claim 12 further comprising a pour spout disposed in one of the four corners of the container body for allowing smooth pouring of material from within the container body wherein the plurality of apertures disposed in the first trough terminate adjacent to the pour spout to prevent material being poured from within the container body from surging upwardly through any of the plurality of apertures.

16. The container structure of claim 12 further comprising a lid for engaging the rim of the container body to enclose the open inner volume of the container body wherein the lid has a first crest for engaging the first trough of the rim of the container body and wherein the first crest has a plurality of male projections extending therefrom for engaging and clearing the plurality of apertures in the first trough.

17. The container structure of claim 16 further comprising a second trough disposed distal to the first trough relative to the open inner volume of the container body, a second crest disposed on the lid for engaging the second trough, a plurality of apertures in the second trough, and a plurality of male projections extending from the second crest for engaging the plurality of apertures in the second trough.

18. The container structure of claim 12 further comprising an insert comprising an elongate body with a plurality of male projections disposed thereon for engaging at least the first trough and the plurality of apertures therein.

19. A multipurpose container structure comprising:

a container body with at least one wall, a bottom sealingly engaged with the at least one wall, and an upper periphery that defines a rim and surrounds an open top of the container body;

whereby the at least one wall and the bottom together define an open inner volume;

wherein at least a portion of the rim comprises a first trough that falls between a first ridge and a second ridge for preventing material contained within the container structure from spilling out of the container structure;

wherein the portion of the rim comprising the first trough further comprises a second trough wherein the second trough is disposed distal to the first trough relative to the open inner volume of the container body whereby material contained within the container structure is further prevented from spilling out of the container structure; and a plurality of apertures disposed in the first trough and a plurality of apertures disposed in the second trough for allowing material to drain into the open inner volume of the container structure from the first and second troughs.

20. The container structure of claim 19 further comprising a lid for engaging the rim of the container body to enclose the open inner volume of the container body wherein the lid has a first crest for engaging the first trough of the rim of the container body and wherein the first crest has a plurality of male projections extending therefrom for engaging and clearing the plurality of apertures in the first trough.

21. The container structure of claim 19 further comprising a lid for engaging the rim of the container body to enclose the open inner volume of the container body wherein the lid has first and second crests for engaging the first and second troughs of the rim of the container body.

22. The container structure of claim 19 further comprising a pour spout disposed in the rim of the container body for allowing smooth pouring of material from within the container body.

23. The container structure of claim 19 further comprising an insert comprising an elongate body with a plurality of male projections disposed thereon for engaging at least the first trough and the plurality of apertures therein.

24. A multipurpose container structure comprising:

a container body with at least one wall, a bottom sealingly engaged with the at least one wall, and an upper periphery that defines a rim and surrounds an open top of the container body;

whereby the at least one wall and the bottom together define an open inner volume;

wherein at least a portion of the rim comprises a first trough that falls between a first ridge and a second ridge for preventing material contained within the container structure from spilling out of the container structure;

wherein a pour spout is disposed in the rim of the container body for allowing smooth pouring of material from within the container body;

wherein the portion of the rim comprising the first trough further comprises a second trough wherein the second trough is disposed distal to the first trough relative to the open inner volume of the container body whereby material contained within the container structure is further prevented from spilling out of the container structure; and wherein the first and second troughs extend around substantially the entire rim of the container body except that the first trough terminates adjacent to the pour spout thereby leaving only the second trough in the portion of the rim adjacent to the pour spout.

25. The container structure of claim 24 further comprising a bail for carrying the container body wherein the bail has a first end rotatably coupled to the at least one wall of the container body, a second end rotatably coupled to the at least one wall of the container body, and a body portion wherein the first and second ends of the bail are rotatably retained relative to the container body by retaining members that are disposed within the open inner volume of the container body whereby the retaining members and the container body present a compact configuration for efficient storage, shipping, and display.

26. The multipurpose container structure of claim 25 further comprising an arcuate bend in the handle of the bail to assist a user in retaining and hanging the container structure.

27. The container structure of claim 24 further comprising a fill line operably associated with the container body for indicating an optimal filling level of the container body.

28. The container structure of claim 24 further comprising a plurality of apertures disposed in the first trough and a plurality of apertures disposed in the second trough for allowing material to drain into the open inner volume of the container structure from the first and second troughs wherein the plurality of apertures of the first and second troughs.

29. A multipurpose container structure comprising:

a container body with at least one wall, a bottom sealingly engaged with the at least one wall, and an upper periphery that defines a rim and surrounds an open top of the container body;

whereby the at least one wall and the bottom together define an open inner volume;

wherein at least a portion of the rim comprises a first trough that falls between a first ridge and a second ridge for preventing material contained within the container structure from spilling out of the container structure;

wherein the container body has first, second, third, and fourth sealingly engaged walls wherein the first, second, third, and fourth walls meet at four corners to define a generally rectangular configuration whereby the generally rectangular configuration of the multipurpose container structure cooperates with the at least one rounded corner of the multipurpose container structure to allow for more efficient retention and storage of retained materials and whereby, when used to retain liquids, the generally rectangular configuration of the multipurpose container structure cooperates with the at least one rounded corner of the multipurpose container structure to induce turbulence during stirring of the retained liquid.

30. The container structure of claim 29 further comprising a bail for carrying the container body wherein the bail has a first end rotatably coupled to the first wall of the container body, a second end rotatably coupled to the third wall of the container body, and a body portion wherein the body portion of the bail comprises a half rectangle shape with first and second legs coupled to the container body and a handle that couples the first and second legs whereby the bail mirrors the shape of the container body to prevent a user's fingers from being pinched between the container body and the bail.

31. The container structure of claim 30 wherein the first and second ends of the bail are rotatably retained relative to the container body by retaining members that are disposed within the open inner volume of the container body whereby the retaining members and the container body present a compact configuration for efficient storage, shipping, and display.

32. The multipurpose container structure of claim 31 further comprising an arcuate bend in the handle of the bail to assist a user in retaining and hanging the container structure.

33. The container structure of claim 29 wherein at least one of the corners is rounded thereby allowing for access to material contained within the at least one rounded corner.

34. A mixing assembly comprising a multipurpose container structure and a stirring paddle:

wherein the multipurpose container structure comprises a container body with at least one wall, a bottom sealingly engaged with the at least one wall, and an upper periphery that defines a rim and surrounds an open top of the container body;

whereby the at least one wall and the bottom together define an open inner volume;

wherein at least a portion of the rim comprises a first trough that falls between a first ridge and a second ridge for preventing material contained within the container structure from spilling out of the container structure;

wherein the container body has first, second, third, and fourth sealingly engaged walls wherein the first, second, third, and fourth walls meet at four corners to define a generally rectangular configuration;

whereby the generally rectangular configuration of the multipurpose container structure cooperates with the at least one rounded corner of the multipurpose container structure to allow for more efficient retention and storage of retained materials and whereby, when used to retain liquids, the generally rectangular configuration of the multipurpose container structure cooperates with the at least one rounded corner of the multipurpose container structure to induce turbulence during stirring of the retained liquid;

wherein at least one of the corners is rounded thereby allowing for access to material contained within the at least one rounded corner; and wherein the stirring paddle comprises an elongate handle that retains a curved paddle that has a curve approximating the curve of the at least one corner of the container body that is curved.

* * * * *